US007100853B2

(12) United States Patent
Wark

(10) Patent No.: US 7,100,853 B2
(45) Date of Patent: Sep. 5, 2006

(54) DEFLECTOR FOR COAL PULVERIZER/CLASSIFIER

(76) Inventor: Rickey E. Wark, 4 Watermark Way, The Woodlands, TX (US) 77381

( * ) Notice: Subject to any disclaimer, the term of this patent is extended or adjusted under 35 U.S.C. 154(b) by 94 days.

(21) Appl. No.: 10/899,885

(22) Filed: Jul. 27, 2004

(65) Prior Publication Data

US 2006/0022075 A1 Feb. 2, 2006

(51) Int. Cl.
*B02C 15/00* (2006.01)
*B02C 1/10* (2006.01)

(52) U.S. Cl. ..... 241/119; 241/300

(58) Field of Classification Search ..... 241/117, 241/119, 79, 79.1, 300
See application file for complete search history.

(56) References Cited

U.S. PATENT DOCUMENTS 2,721,036 A * 10/1955 Kueneman et al. ..... 241/269
4,201,350 A * 5/1980 Eagens ..... 241/298
4,234,132 A * 11/1980 Maliszewski, Jr. ..... 241/53
4,605,174 A * 8/1986 Maliszewski et al. ..... 241/52
4,907,751 A 3/1990 Wark et al.
5,054,697 A 10/1991 Provost
5,090,631 A 2/1992 Wark
5,127,590 A 7/1992 Bunton
5,186,404 A 2/1993 Wark
5,340,041 A 8/1994 Henning et al.
5,549,251 A 8/1996 Provost
5,819,947 A 10/1998 Nardi et al.
5,957,300 A 9/1999 Nardi et al.
6,409,108 B1 6/2002 Wark et al.

* cited by examiner

*Primary Examiner*—Faye Francis
(74) *Attorney, Agent, or Firm*—Young & Basile, P.C.

(57) ABSTRACT

A deflector disposed immediately above and outboard of a rotating vane wheel in a pulverizer/classifier is protected from wear and abrasion by side-by-side abutting high-hardness wear plates having an alloy content of approximately 15 percent chromium and three percent molybdenum by weight. The abutting edge surfaces of the wear plates are mitered. For pulverizers/classifiers having discontinuous deflectors, end plates are disposed over the end surfaces of the deflector segments and are serrated. Inside threaded fasteners are used to hold the wear plates in place over the lower surface of the deflector.

10 Claims, 4 Drawing Sheets

DEFLECTOR FOR COAL PULVERIZER/CLASSIFIER

FIELD OF THE INVENTION

This invention relates to coal pulverizers/classifiers and more particularly to an improvement in the construction of circumferential deflectors disposed on the interior wall of the pulverizer/classifier housing spaced in operative relationship to a vane wheel which causes an upwardly spiral pattern of airborne coal fines.

BACKGROUND OF THE INVENTION

Coal pulverizers/classifiers are well known structures used in coal-fired electrical power generating plants to crush lump coal into fines which are suitable for use in fueling boiler fireboxes. A typical coal pulverizer/classifier comprises a vertical and substantially cylindrical housing containing a pulverizer bowl and crusher rollers in engagement therewith. A vane wheel is typically mounted on the outer peripheral surface of the bowl to rotate therewith. The vane wheel has angled vanes to produce an upwardly spiral air flow within the interior of the housing which air flow carries coal fines through a classifier assembly. A coal pulverizer/classifier of the type generally described is further illustrated and described in U.S. Pat. No. 4,907,751, issued Mar. 13, 1990, the disclosure of which is incorporated by reference herein.

As disclosed in the above-identified patent, it is desirable to use a circumferential deflector above and radially outside of the vane wheel to direct the upwardly spiral pattern of airborne coal fines back toward the center of the pulverizer/classifier housing. Because of the abrasive nature of the airborne coal fines, this deflector is subject to abrasive wear.

SUMMARY OF THE INVENTION

It is an object of the present invention to improve on the construction and operation of coal pulverizers/classifiers of the type described above by, in particular, providing an improved deflector structure which is highly wear resistant as well as easy to install in new pulverizers/classifiers as well as to retrofit in older existing pulverizers/classifiers of the type described above.

In general, the present invention comprises a deflector which includes an outwardly angled lower circumferential surface and an intersecting inwardly angled upper circumferential surface, the two surfaces in combination with the interior cylindrical wall of the housing forming a hollow interior volume which extends circumferentially around the housing above and adjacent the location of the vane wheel. A plurality of contiguous and abutting wear plates are disposed over the lower circumferential surface with mitered abutting edge surfaces which form a joint therebetween, the mitered surfaces being angled away from the direction of air flow in the upwardly spiral pattern. In addition, fasteners are provided for securing the wear plates to the lower circumferential surface from the inside; i.e., fasteners are provided having heads which are disposed within the hollow interior volume. The word "heads", as used herein, refers to the portion of a mechanical fastener which is susceptible to manipulation with a tool to assemble or disassemble the fastener and the fastened plate. Examples include nuts, bolt heads and certain types of clips. The fastener is preferably "blind"; i.e., does not extend through the attached wear plate to the exposed outer surface thereof.

In the preferred form, the upper surface of the deflector is constructed with removable panels to provide access to the interior volume so that the heads of the fasteners for the contiguously abutting wear plates on the lower circumferential surface can be reached for assembly and disassembly purposes.

As will be apparent to persons skilled in the coal pulverizer/classifier technology, there are classifiers with circumferentially continuous as well as discontinuous deflector structures depending on the presence or absence of structures such as roller trunnions which extend through the outside wall of the pulverizer/classifier housing. The present invention works equally well with both types of classifiers. In the case of discontinuous deflectors, the discontinuity generally results in the presence of at least one, and typically two or three, sets of deflector end surfaces. In accordance with the present invention, those surfaces which are most directly impinged by coal fines in the upwardly spiral pattern are protected with fluted or serrated wear plates, the fluted or serrated pattern tending to run vertically to provide maximum protection. The terms "fluted" and "serrated" are used synonymously herein to refer to any pattern having alternate peaks and valleys including those which are directionally angled as well as symmetrical.

The wear plates of the present invention are preferably constructed of high-hardness steel with a chromium and molybdenum content so as to produce a hardness of at least about 65 Rockwell C. It will be understood, however, that other materials of construction such as carbides may also be used.

Other applications of the present invention will become apparent to those skilled in the art when the following description of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and wherein.

DETAILED DESCRIPTION OF THE ILLUSTRATIVE EMBODIMENTS

Figure 1:
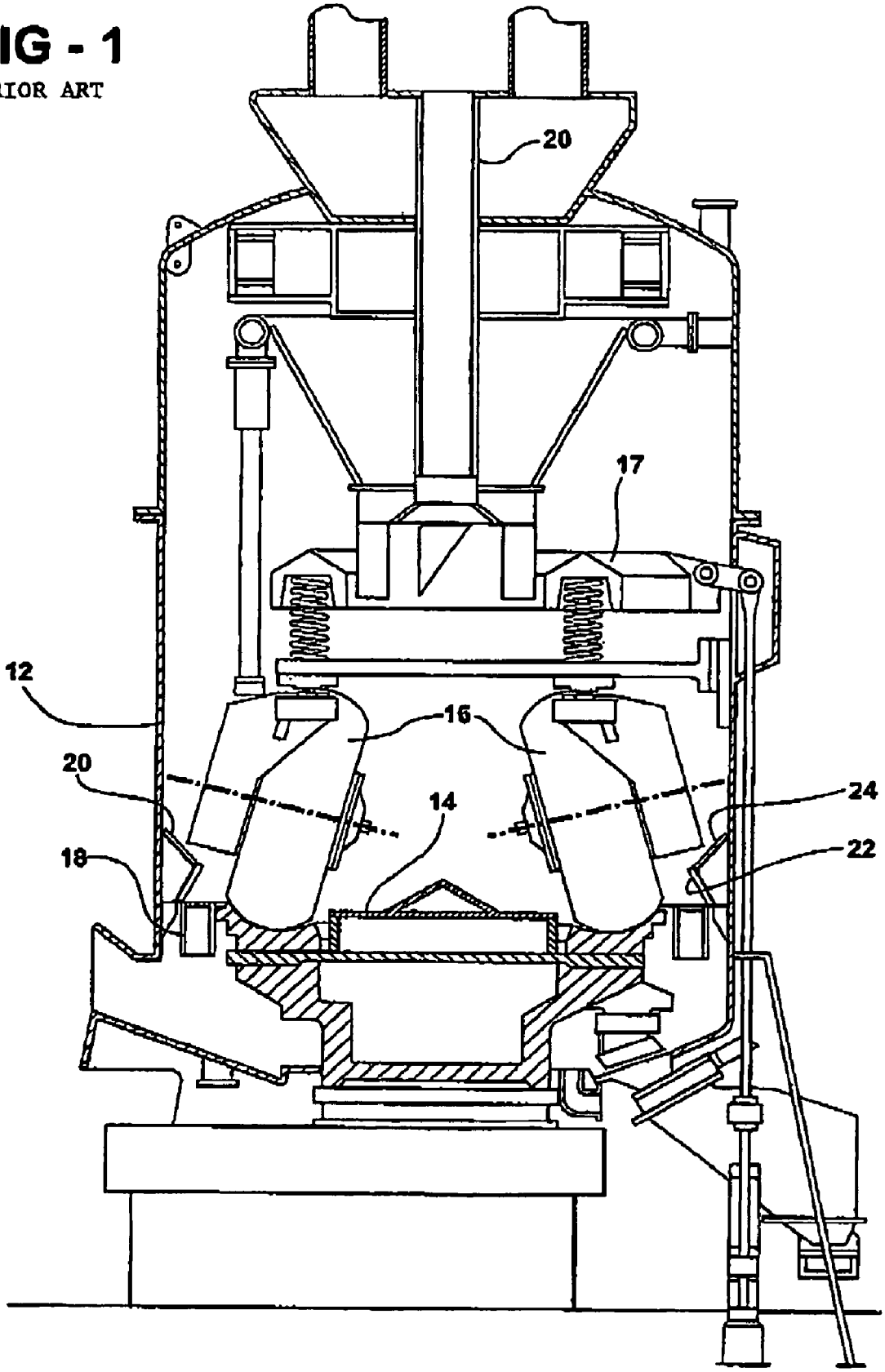
FIG - 1 PRIOR ART
FIG. 1 is a side view in section of a first type of pulverizer/classifier suitable for use in the present invention.

Referring to FIG. 1, a coal pulverizer/classifier 10 is shown to comprise a generally cylindrical steel housing 12 having a vertical axis of symmetry. The housing 12 contains in the lower portion thereof a rotatable crusher bowl 14 which is contacted by crusher rollers 16 supported by overhead structure 17. A vane wheel 18 is attached to the outer perimeter of the bowl 14 to rotate therewith in inwardly spaced relationship to the inner wall of the housing 12. Formed on the inner wall adjacent and immediately above the vane wheel 18 is a deflector 20 comprising the combination of an upwardly and inwardly angled structure 22 forming a first deflector surface and an upwardly and outwardly angled structure 24 forming a second deflector surface. The two structures 22 and 24 intersect to form along with the inner wall of the housing 12 a generally triangular volume which extends circumferentially around the interior of the housing 12 in a continuous fashion.

As is more fully described in the aforementioned patent to Wark and Cunningham, the pulverizer/classifier 10 is equipped to provide an upward flow of air which performs the classifier function and carries coal fines upwardly into the classifier section of the pulverizer/classifier 10 through the vanes of the vane wheel 18 in an upwardly spiraling fashion. The primary lower surface of the deflector structure 22 tends to direct the air flow inwardly toward the center of the housing 12.

Figure 2:
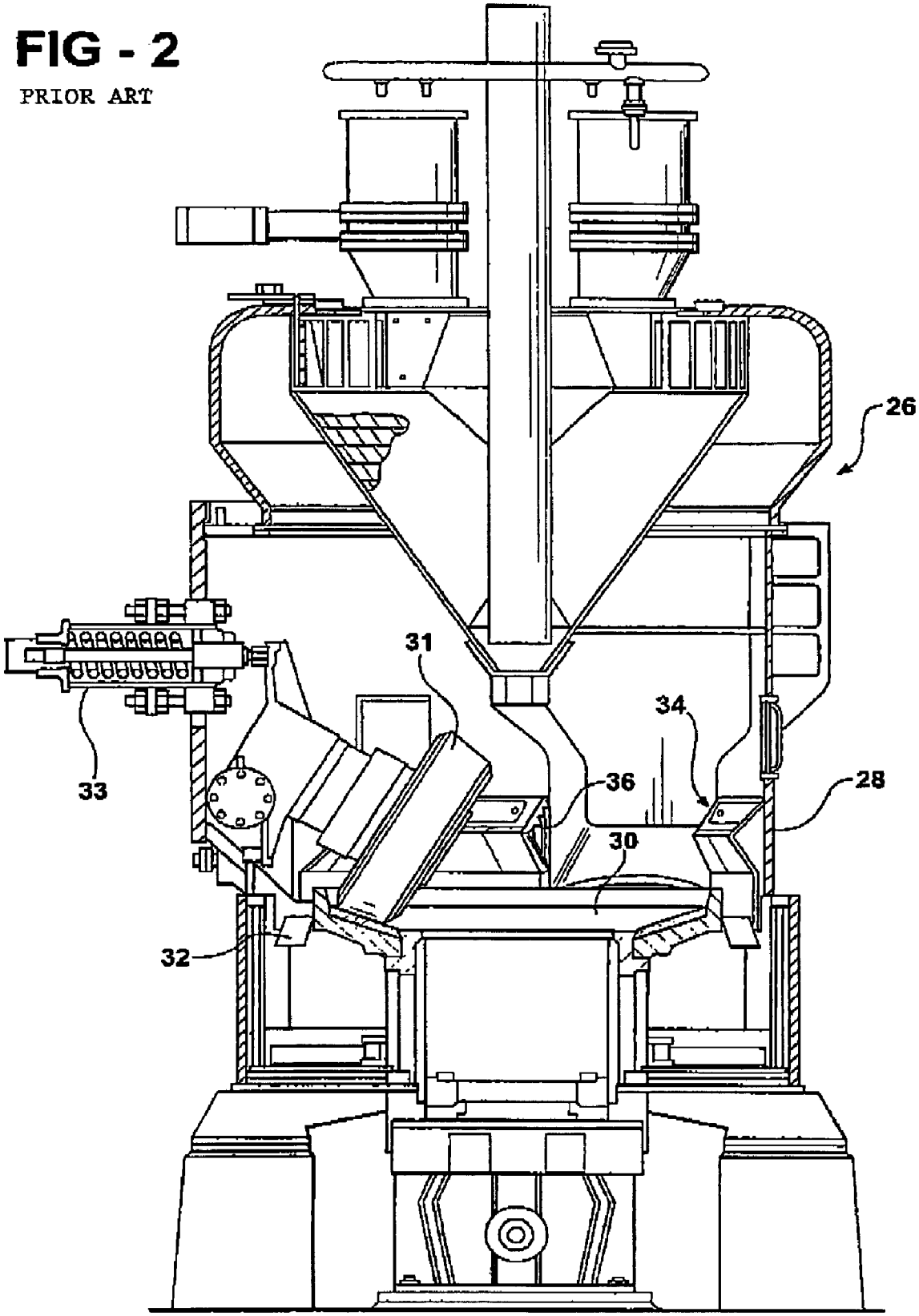
FIG - 2 PRIOR ART
FIG. 2 is a side view in section of a second type of pulverizer/classifier suitable for use in combination with the present invention.
Figure 3:
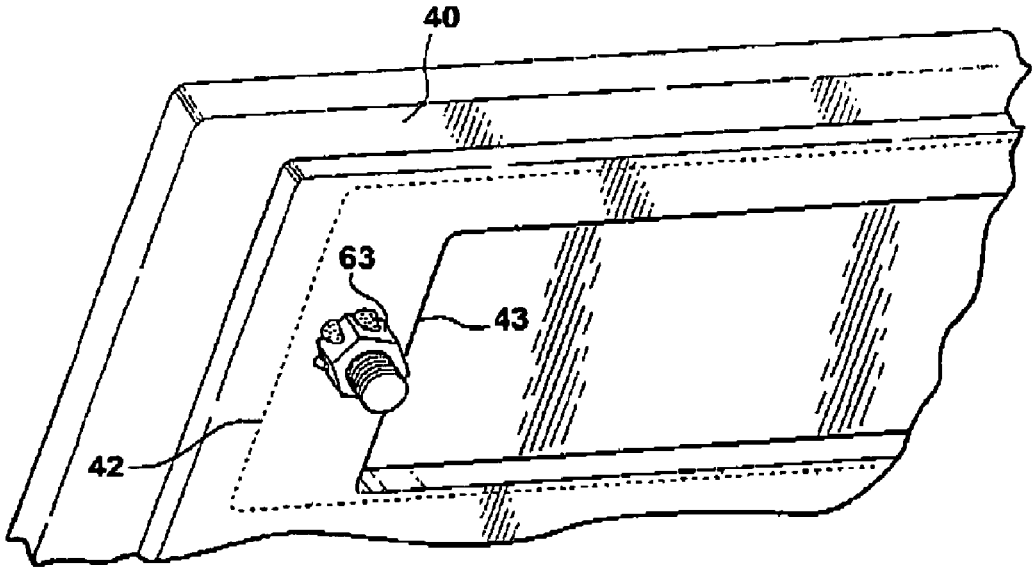
FIG. 3 is a rear perspective of a portion of a deflector useful in the pulverizer/classifier of FIGS. 1 and 2.

Referring to FIG. 2, a second pulverizer/classifier 26 is shown to again comprise a generally cylindrical vertically oriented housing 28 and a pulverizer bowl 30. A crusher wheel 31, one of three which are typically used in a structure of this type, is shown mounted by way of suspension 33 extending through a side wall of the housing 28 to contact the crusher surface of the bowl 30. A vane wheel 32 rotates with the bowl 30 and a deflector structure 34 is shown mounted on the interior wall of the housing 28 immediately above the outlets of the vane wheel 32. Because of the manner in which the crushers 31 are mounted; i.e., with suspensions which extend through the side wall of the housing 28, the deflector 34 is discontinuous thereby defining a number of triangular sidewalls 36 at the points of discontinuity.

The pulverizers/classifiers of FIGS. 1 and 2 are illustrated by way of background as to be representative of the two types of pulverizers/classifiers which are in common use at the present time. The deflector structures of the present invention, although in different forms, are equally usable in combination with the two illustrated types of pulverizers/classifiers as well as other types as will be apparent from the following specification.

Referring now to FIGS. 3–6, the details of the improved deflector structures 34 and 34' will be described. These drawings illustrate two slightly different vane wheels and deflector structures 34 and 34' which are particular to the pulverizer of FIG. 2. However, except for side plates hereinafter described, the illustrated deflectors and vane wheels are generic to both types of pulverizers.

Figure 4:
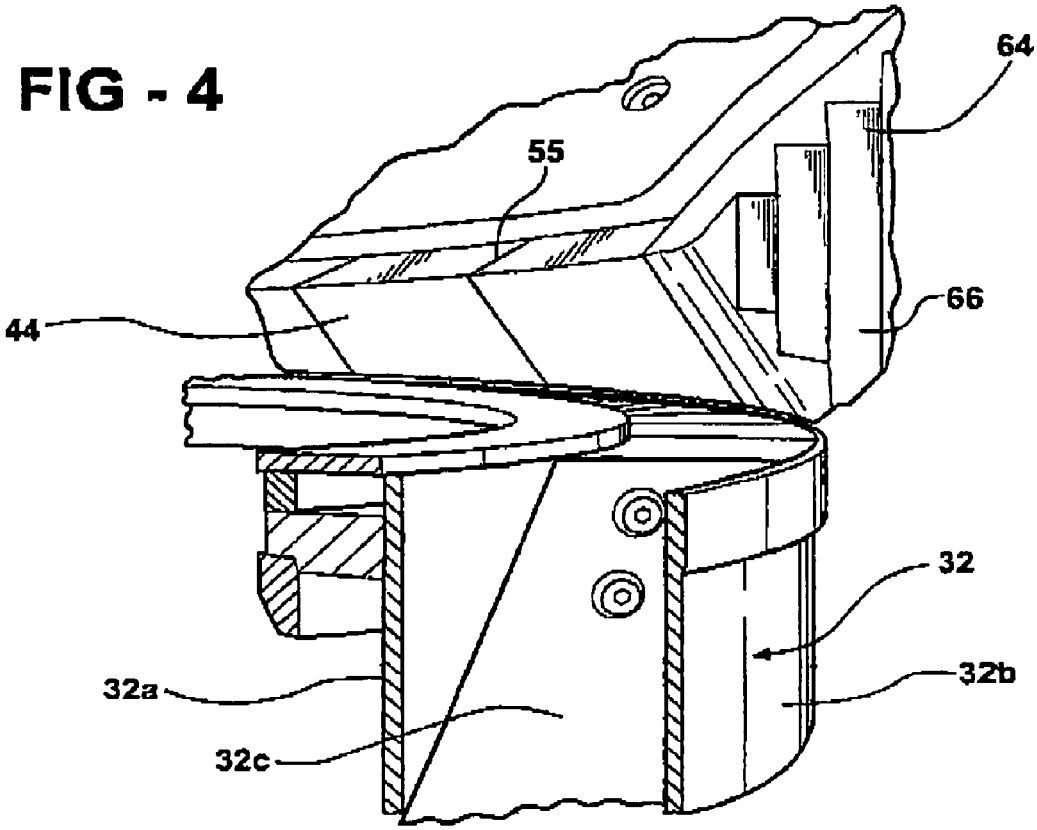
FIG. 4 is a perspective view of the deflector of FIG. 3 further showing a portion of a first type of vane wheel disposed in operative association therewith.
Figure 6:
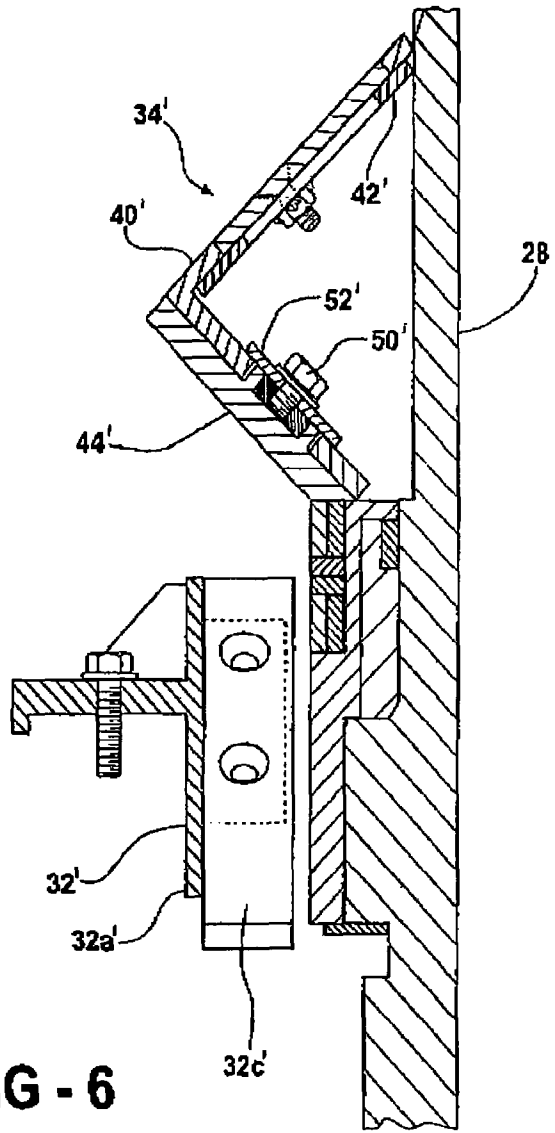
FIG. 6 is a sectional view of a deflector structure similar to that of FIG. 5 but used in combination with a different type of vane wheel.
Figure 5:
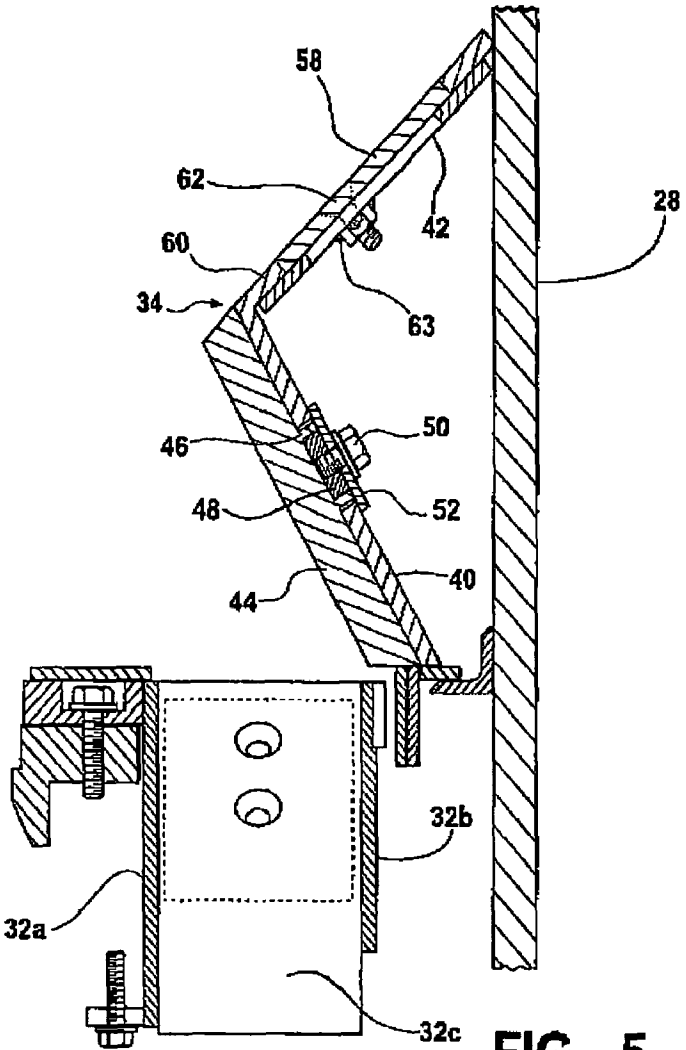
FIG. 5 is a sectional view of the structure of FIG. 4 illustrating the details of construction of the deflector as well as the vane wheel.

As best shown in FIGS. 5 and 6, deflectors 34 and 34' include a circumferential backer structure 40 comprising two curved plates welded together to form the upper and lower walls of the circumferential deflectors. The structure 40 is constructed from mild steel with regularly spaced small openings in the lower wall to receive fasteners and larger openings in the upper wall to provide access to the interior of the volume defined by the deflector structure 40 and the inner surface of the housing wall 28. Wear plates 44 are disposed in a contiguous array on the outside surface of the lower wall of structures 34 and 34'. The plates 44 have mitered edge surfaces forming inwardly angled butt joints 55 as shown in FIG. 4. It will be seen that the mitered joints extend outwardly away from the direction of the flow of the airborne coal fines thereby to protect the mitered joints from wear. The plates 44 are not welded, but fit tightly together to form the joints 55.

Each wear plate 44 is formed by casting with at least one circular boss 46 on the inside surface which boss fits into the small opening of the lower wall in structure 40. A mild steel insert 48 with cast-in threads is cast into each boss 46. The threaded hole in the insert 48 in turn receives a bolt 50 with a head which seats on a large washer or spacer 52 to secure the wear plates 44 to the lower wall of deflector structure 40. Because of the upward flow over the vanes 32*c*, only the lower surface of the deflectors 34 and 34' requires protection against abrasive wear. For this reason, the plates 44 are contiguous and the joints 55 are arranged in the manner shown. Moreover, it is important to have the head of the fastener 50 on the interior of the volume so that it is not subjected to direct impact by the upward spiraling flow of the coal fines. The lower wall of structure 40 is the same thickness as the boss 46.

The upper wall of structure 40, as described above, has large openings for access to the interior of the deflector. A series of backer plates 42 with openings 43 corresponding to but smaller than the openings in the upper wall of structure 40 are welded to structure 40 on the interior side. Nuts 63 are welded to the interior surfaces of the plates 42 on both sides of the openings 43 and correspond in location to holes through steel access plates 58 which fit into the openings in the upper wall of structure 40. Plates 58 correspond in thickness to structure 40 and close the openings after the wear plates 44 are installed. The structure 40, the backer plate 42 and the access plates 58 may all be made of mild steel.

Referring now to FIG. 5, the vane wheel 32 is shown to comprise an inner wall 32*a*, an outer wall 32*b* and angled vanes 32*c* disposed therebetween. The entire structure is welded together in a known manner and is available from Sure Alloy Steel Corporation in Madison Heights, Mich.

Referring to FIG. 6, there is shown a modified vane wheel 32' which differs from the vane wheel 32 of FIG. 5 in that the vanes 32*c'* are cantilevered in their attachment to the inner wall 32*a'*, i.e., the vane wheel of FIG. 6 does not have an outer wall 32*b*. This provides for a narrower structure and is used where radial clearance is a problem. Otherwise, the deflector structure 34' of FIG. 6 is essentially identical to the deflector structure 34 of FIG. 5. Similar parts are given the same reference numbers with primes in FIG. 6.

As shown in FIGS. 2 and 4, the discontinuous deflector produces a number of end wall surfaces 36 which, according to the invention, are protected by means of serrated wear plates 64 having serrations or flutes 66 as best shown in FIG. 4. These plates are again preferably attached from the inside using bosses and a fastener arrangement similar to that shown in FIGS. 5 and 6 for plates 44. The end wall wear plate 64 preferably overlaps and protects the edge surface of the wear plate 44 as best shown in FIG. 4.

All of the wear plates are made of a high hardness steel having a high chromium and molybdenum content; i.e., the chromium content is approximately 15 percent by weight and the molybdenum content is approximately three percent by weight. The resulting alloy has a hardness of approximately 65–67 on the Rockwell C scale.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In a coal pulverizer/classifier of the type having a substantially cylindrical vertical housing with an interior wall and a mechanism for causing coal fines to flow within the housing in an upwardly spiral pattern:

a substantially circular deflector mounted on the inner wall of the housing and being characterized by an outwardly angled lower circumferential surface and an intersecting, inwardly angled upper circumferential surface, said surfaces together with said wall forming a hollow interior;

a plurality of contiguous wear plates disposed over the lower circumferential surface with beveled abutting edge surfaces forming joints therebetween, said beveled abutting edge surfaces being angled away from the direction of coal fines flow in said upwardly spiral pattern; and blind fasteners securing the wear plates to said lower circumferential surface, said fasteners having heads disposed within said hollow interior.

2. The combination defined in claim 1 wherein said lower circumferential surface is constructed with substantially regularly spaced openings.

3. The combination defined in claim 1 further including a plurality of access openings formed in said upper circumferential surface.

4. The combination defined in claim 1 wherein said deflector is circumferentially continuous around said interior surface.

5. The combination defined in claim 1 wherein said deflector is circumferentially discontinuous, the discontinuities defining at least one vertical end surface toward which coal fines are directed in said upwardly spiral pattern.

6. The combination defined in claim 5 further including a wear plate disposed on said end surface.

7. The combination defined in claim 6 further including vertical strakes formed in said wear plate.

8. The combination defined in claim 1 wherein said wear plates are made of steel having a high chromium content so as to produce a hardness level of at least about 65 Rockwell C.

9. The combination defined in claim 8 wherein the wear plates are constructed of steel with a high chromium content and a hardness of at least about 65 Rockwell C.

10. The combination defined in claim 2 wherein said wear plates are cast with bosses fitting into the openings in the lower circumferential structure, the combination further comprising inserts secured into the bosses to receive said fasteners.

* * * * *